US006429549B1

(12) United States Patent
Muroi et al.

(10) Patent No.: US 6,429,549 B1
(45) Date of Patent: Aug. 6, 2002

(54) TIME SWITCH

(75) Inventors: Hiroaki Muroi, Osaka; Kazuo Yanagida, Gunma, both of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/456,528

(22) Filed: Dec. 8, 1999

(30) Foreign Application Priority Data

Dec. 22, 1998 (JP) ..... 10-365656

(51) Int. Cl.[7] ..... H01H 43/02
(52) U.S. Cl. ..... 307/125; 307/132 R
(58) Field of Search ..... 307/132 R, 125

(56) References Cited

U.S. PATENT DOCUMENTS 4,318,181 A * 3/1982 Kawakami et al. ..... 364/569
4,862,499 A * 8/1989 Jekot et al. ..... 379/368
5,329,082 A 7/1994 Saarem ..... 200/38 D
5,715,866 A * 2/1998 Granger ..... 137/624.11

* cited by examiner

*Primary Examiner*—Fritz Fleming
(74) *Attorney, Agent, or Firm*—Armstrong, Westerman & Hattori, LLP

(57) ABSTRACT

A time switch includes a circuit board equipped with a time switch circuit and a display for displaying a time-schedule set by a user and current time, an operation unit having push buttons for setting the time-schedule and current time, and a casing in which the circuit board and operation unit are accommodated, the casing having openings for fitting the push buttons. The operation unit includes a resilient sheet member integrally equipped with the push buttons and conductive contact members each disposed on a portion corresponding to each of the push buttons. The circuit board has pairs of contact portions, each pair of contact portions being electrically connected via the conductive contact member while the push button is depressed. The operation unit is supported the casing and the circuit board in a state that a peripheral portion of the sheet member is clamped by and between an inner surface of the casing and the circuit board with the buttons fitted in the openings.

7 Claims, 15 Drawing Sheets

TIME SWITCH

BACKGROUND OF THE INVENTION

1. Field of the Invention

This invention relates to a time switch for controlling a load at a predetermined time.

2. Description of the Related Art

FIG. 18 illustrates an example of this kind of time switch as related art. This time switch includes a boxed-shaped main casing 11 having a front opened end, a printed circuit board 32' placed in the main casing 11, and an inner cover plate 12 covering the front opened end of the main casing 11.

The printed circuit board 32' is equipped with a clock function block 21 having a liquid crystal display and a plurality of push buttons, a terminal block 22 for connecting loads, and a load controlling relay 23. The circuit board 32' is fitted in and fixed to the main casing 11 by tightening screws 13. The main casing 11 is coved by an outer cover (not shown). The inner cover plate 12 is disposed at the front opened end so as to cover the whole area of the printed circuit board 32' and fixed to the main casing 11 by tightening screws 14. In this state, the clock function block 21 is exposed through the opening 12*a* formed in the inner cover plate 12.

However, according to the aforementioned structure, when loads are connected the terminal block 22, since the inner cover plate 12 covers not only the circuit board 32' but also the terminal block 22, the inner cover plate 12 should be detached from the main casing 11. As a result, the whole area of the circuit board 32' (i.e. the parts provided on the circuit boards 32' ) will be exposed. This allows a wire of the load and/or a tool such as a screwdriver to contact the parts, resulting in unintentional damages to the parts. Furthermore, since the circuit board 32' is exposed during the connecting operation of the load, foreign substances may adhere to the parts circuit boards 32' and/or the load. This may also cause a breakage problem thereof. In addition, the clock function block is complicated in structure, resulting in an increased manufacturing cost.

U.S. Pat. No. 5,329,082 discloses a time switch equipped with a mechanical clock function block mounted on a plastic plate and a circuit board having a terminal block. The circuit board is also connected to the plastic plate so that the terminal block is exposed. According to this construction, a connecting operation of the load to the terminal block may be performed without causing any problems or damages to the clock function block, and an adherence by foreign substances can be avoided. Thus, unexpected damages of the clock function block or accidents may be avoided. However, since the terminal block is fixed to the plastic plate together with the clock function block, in a case where different types of time switches are manufactured, it is required to manufacture different types of terminal blocks designed for the respective type of time switch. Thus, the terminal block cannot be used for different types of time switch, resulting in an increased manufacturing cost.

Furthermore, in this structure, in a case where a quality testing is performed to confirm the functions at the stage of designing the product, it is required to evaluate not only the clock function block but also the terminal block. Thus, a larger number of points should be checked as compared to only checking the clock function block, which causes an increased labor for the evaluation.

SUMMARY OF THE INVENTION

An object of the present invention is to provide a time switch which is simple in structure and low in manufacturing cost.

Another object of the present invention is to provide a time switch in which an connecting operation of a load to a terminal block can be performed without causing any damages or problems.

Still another object of the present invention is to provide a time switch which can easily perform an evaluation test.

Yet another object of the present invention is to provide a time switch having a common part which can be used for different types of time switches.

According to a first aspect of the present invention, a time switch includes a circuit board equipped with a time switch circuit and a display for displaying a time-schedule set by a user and a current time, an operation unit having a plurality of push buttons for setting the time-schedule and the current time, and a casing in which the circuit board and the operation unit are accommodated, the casing having a plurality of openings for fitting the plurality of push buttons. The operation unit includes a resilient sheet member integrally equipped with the plurality of push buttons and a plurality of conductive contact members each disposed on a portion corresponding to each of the plurality of push buttons. The circuit board has pairs of contact portions. Each pair of the contact portions is to be electrically connected via the conductive contact member while the push button is being depressed. The operation unit is supported by the casing and the circuit board in a state that a peripheral portion of the sheet member is clamped by and between an inner surface of the casing and the circuit board with the plurality of push buttons fitted in the plurality of openings.

With this time switch, since the operation unit is supported by the casing and the circuit board, the time switch can be simple in structure, resulting in an easy assembly and a reduced manufacturing cost.

According to a second aspect of the present invention, a time switch includes a circuit board equipped with a time switch circuit and a display for displaying a time-schedule set by a user and a current time, an operation unit having a plurality of buttons for setting the time-schedule and the current time, a casing in which the circuit board and the operation unit are accommodated, the casing having a plurality of openings for fitting switches and pilot lamps provided on the circuit board, and a display sheet attached on a surface of the casing, the display sheet having a plurality of openings for exposing the switches and pilot lamps. The number of the openings formed in the casing corresponds to the maximum number of the switches and pilots lamps to be provided on the circuit board. Furthermore, the number of the opening formed in the display sheet corresponds to the number of the switches and pilots lamps actually provided on the circuit board, whereby some of the opening formed in the casing not in use are covered by the display sheet.

With this time switch, even in a case where the operation of the circuit board and/or the number of parts provided on the circuit board are changed, it is only required to change a display sheet to be attached on the casing. In other words, it is not required to change the casing. As a result, the storage space can be decreased, and various types of time switches can easily be provided.

Other objects and advantages of the present invention will become apparent from the description of the preferred embodiments, which may be modified in any manner without departing from the scope and spirit of the present invention.

DETAILED DESCRIPTION OF THE PREFERRED EMBODIMENTS

Preferred embodiments of a time switch according to the present invention will now be described in detail with reference to the accompanying drawings.

(First Embodiment)

Figure 1:
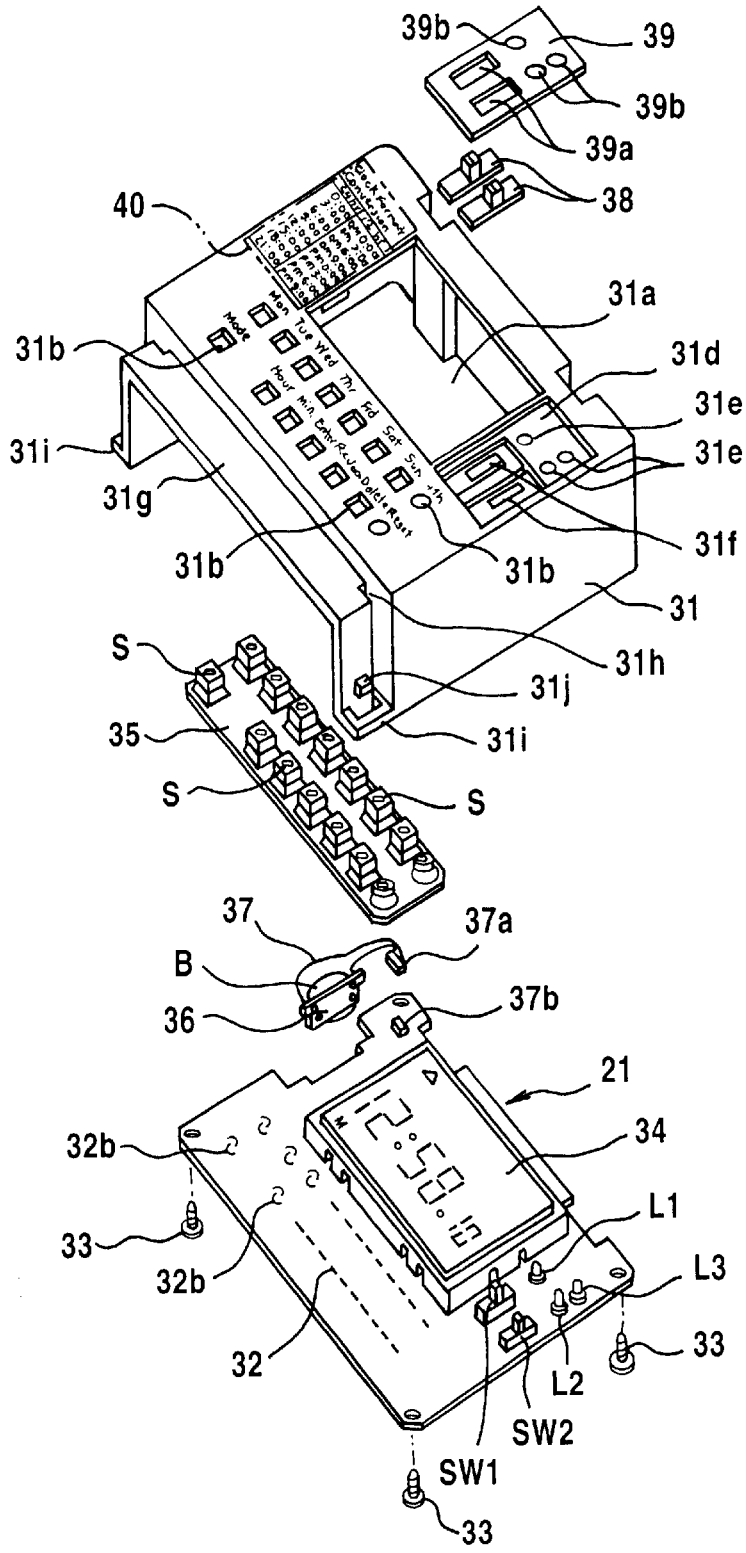
FIG. 1 is an explode perspective view of a main portion of a time switch according to a first embodiment of the present invention.
Figure 2:
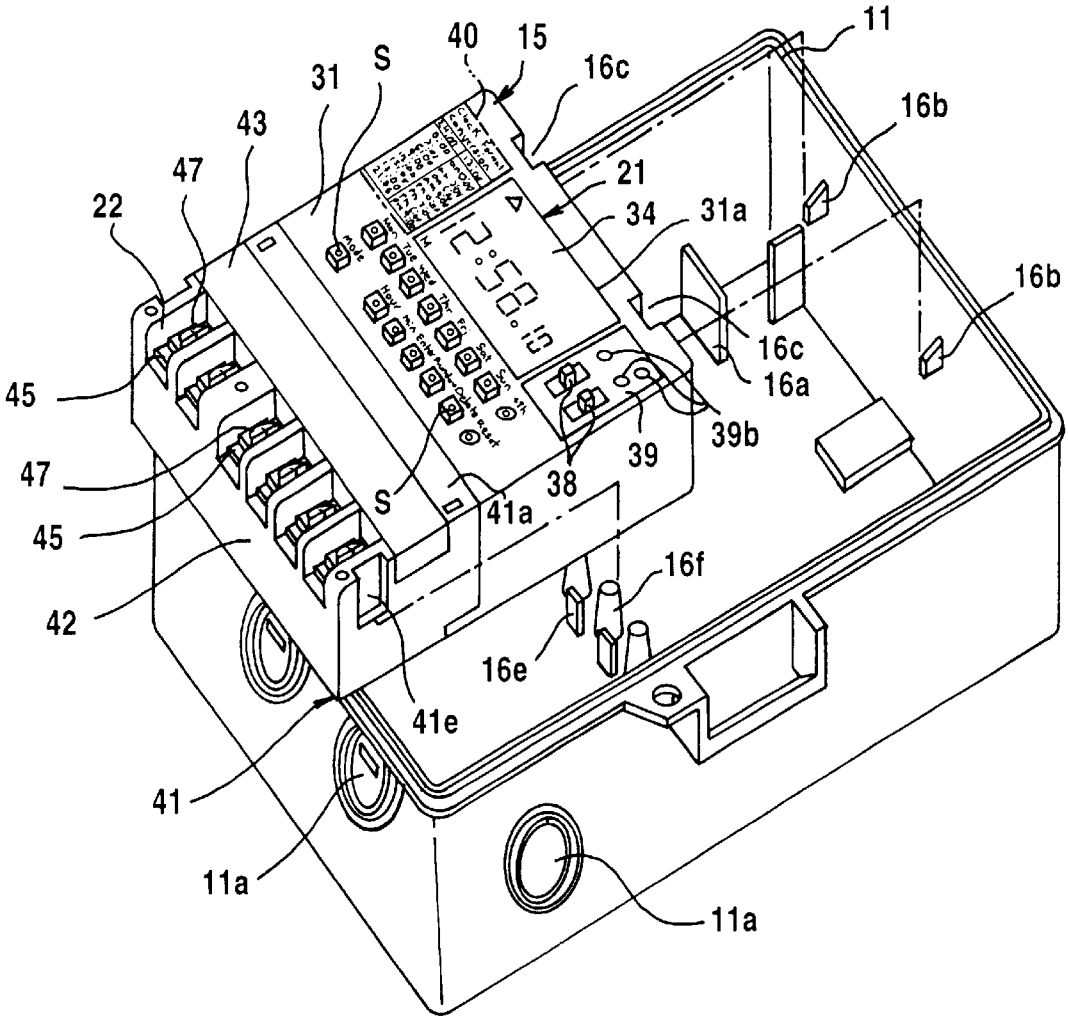
FIG. 2 is a perspective view of the main portion in a state that the main portion is detached from an outer main casing.

As shown in FIG. 2, the time switch includes a front cover (not shown), an outer main casing 11 and an inner casing 15 mounted in the outer main casing 11. The outer main casing is covered by the inner casing 15 is comprised of an inner main casing 31 and a terminal holder 41 detachably connected to the inner main casing 31 (see FIG. 3). The inner main casing 31 has a clock function block 21 including an electric timer circuit (see FIG. 1). The terminal holder 41 includes a terminal block 42 to which a power source and loads are connected and a load controlling relay 23 (see FIG. 10).

Figure 4:
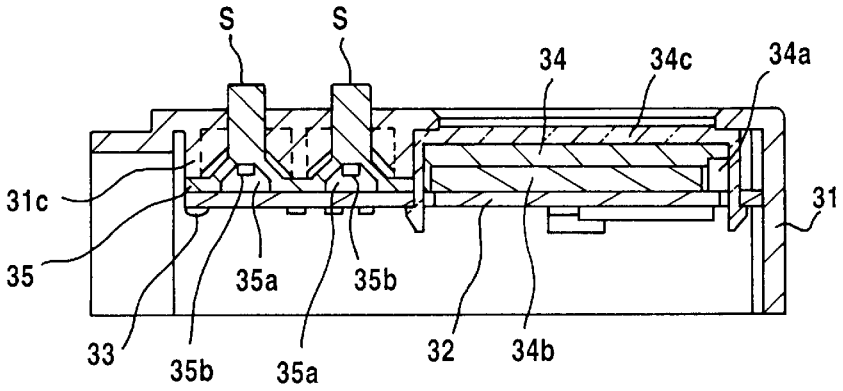
FIG. 4 is an enlarged cross-sectional view of the inner main casing.
Figure 5:
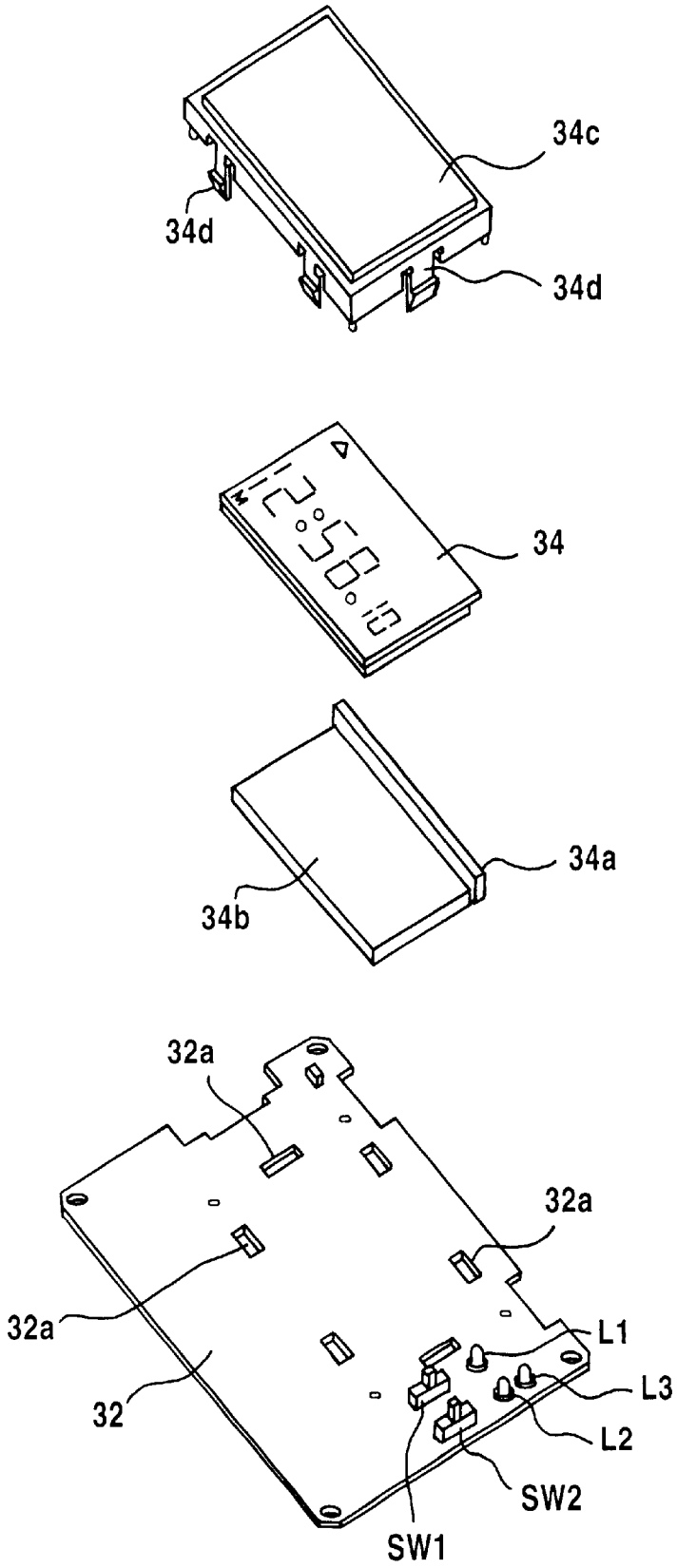
FIG. 5 is an exploded perspective view of the clock function block.

As shown in FIGS. 1 and 4, the inner main casing 31 is a box-shaped casing with a lower opened end and a rear opened end, and covers a printed circuit board 32 equipped with the clock function block 21. The printed circuit board 32 is fitted in and fixed to the inner main casing 31 by tightening screws 33 inserted through the printed circuit board 32 from the rear side thereof. The printed circuit board 32 is equipped with a liquid crystal display (hereinafter referred to as "LCD") 34. As shown in FIG. 5, the LCD 34 is electrically connected to the printed electric circuits of the printed circuit board 32 via a connector plate 34*a* made of conductive rubber. Between the LCD 34 and the printed circuit board 32, a sponge-like cushion sheet 34*b* is disposed. The LCD 34 is secured to the printed circuit board 32 by a shallow box-shaped display casing 34*c* made of transparent resin. The LCD 34 is secured to the printed circuit board 32 via the cushion sheet 34*b* and the connector plate 34*a* by fixing the display casing 34*c* to the circuit board 32 in such a state that the LCD 34 and the connector plate 34*a* are fitted in the display casing 34*c*. Thus, the LCD 34 is electrically connected to the printed circuit board 32. The display casing 34*c* is secured to the printed circuit board 32 by engaging the engaging ledges 34*d* formed at the rear peripheral edge of the display casing 34*c* with the corresponding engaging holes 32*a* provided in the printed circuit board 32.

Figure 6A:
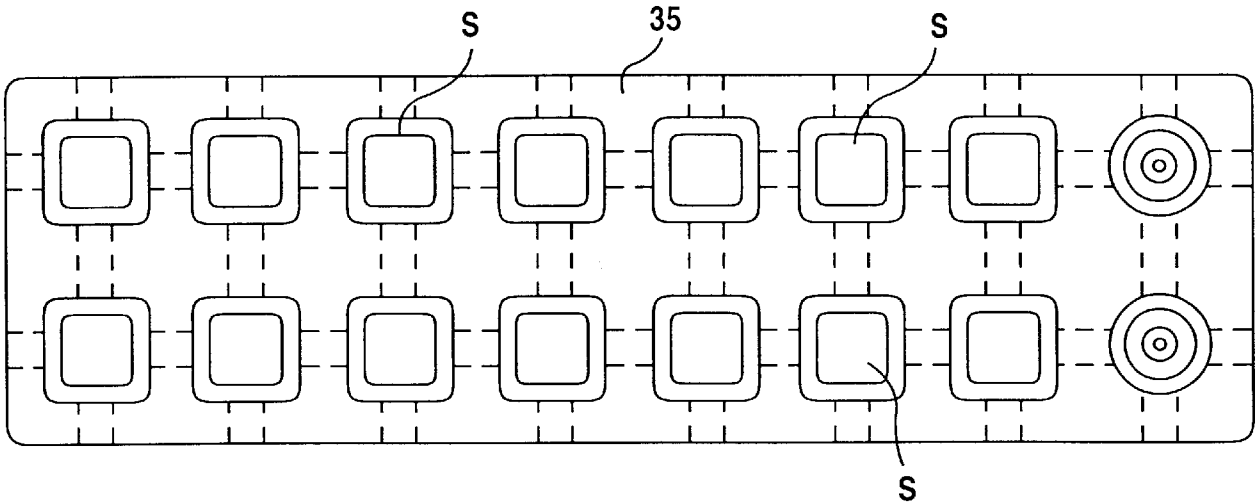
FIG. 6A is a top view of the operation unit.
Figure 6B:
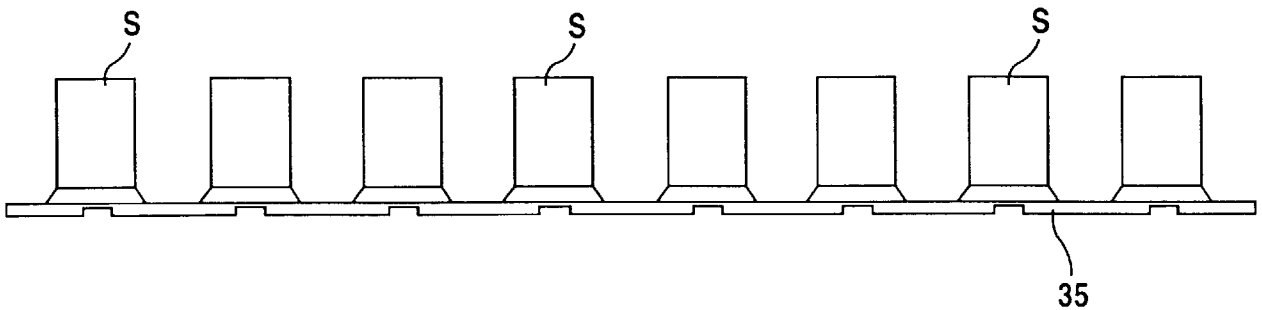
FIG. 6B is a side view of the operation unit.
Figure 7:
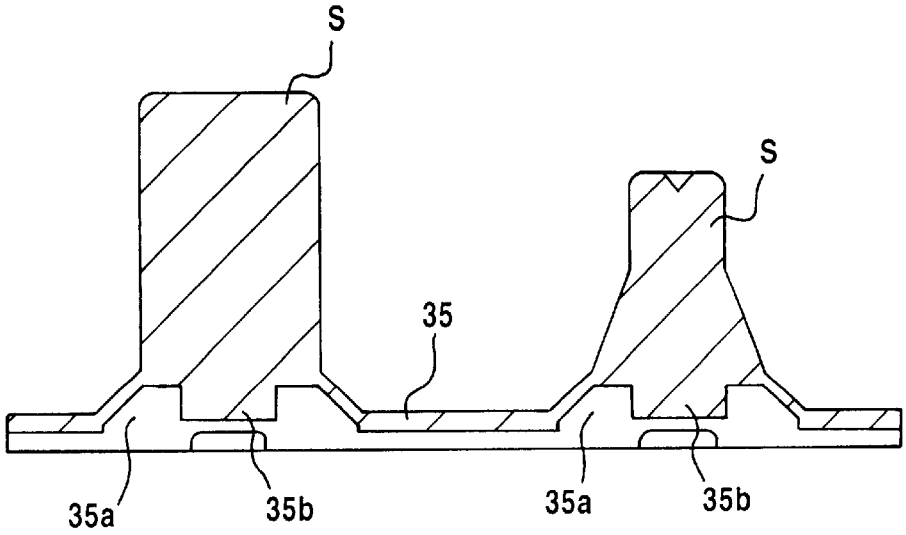
FIG. 7 is an enlarged cross-sectional view of the operation unit.
Figure 8:
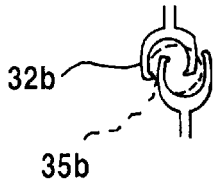
FIG. 8 illustrates a pair of contact portions.

The time switch according to this embodiment is provided with a plurality of operation buttons S for setting the current time and for setting the time for operating the loads connected to the time switch. As shown in FIGS. 6A and 6B, these operation buttons (push button) S are integrally formed on a front surface of the sheet member 35 having rubber elasticity. As shown in FIG. 7, the sheet member 35 has, at its rear surface, a plurality of tapered dented portions 35*a* each formed at a portion corresponding to the operation buttons S. Each of the tapered dented portions 35*a* has a slanted peripheral wall gradually decreasing the diameter from the rear surface of the sheet member 35 toward the front surface thereof. The peripheral wall is formed to be thinner than the other portion of the sheet member 35. At the bottom of each dented portion 35*a*, a conductive movable contact member 35*b* is fixed such that the lower surface thereof is inwardly located with regard to the rear surface of the sheet member 35. Accordingly, when the operation button S is depressed, the peripheral wall of the dented portion 35*a* corresponding to the depressed operation button S is warped downward to cause the downward movement of the movable contact member 35*b*. Thus, the movable contact member 34*b* protrudes from the rear surface of the sheet member 35 toward the printed circuit board 32. From this state, when the depressing force of the operation button S is released, the movable contact member 35*b* returns to its original position due to the elasticity of the sheet member 35. As shown in FIGS. 1 and 8, the printed circuit board 32 has pairs of conductive printed patterns (contact portions) 32*b*, each pair being a combination of a generally Y-shaped conductive printed pattern and an inverted generally Y-shaped conductive printed pattern. When the operation button S is depressed, the movable contact member 35*b* contacts to a corresponding pair of conductive printed patterns 32*b* to cause an electrical conduct of the pair of generally Y-shaped conductive printed patterns 32*b*. This functions as a momentary-type press button, i.e., a button which becomes ON state only when the button is being depressed.

Thus, a so-called rubber switch is formed by the sheet member 35 and the printed circuit board 32.

Figure 9:
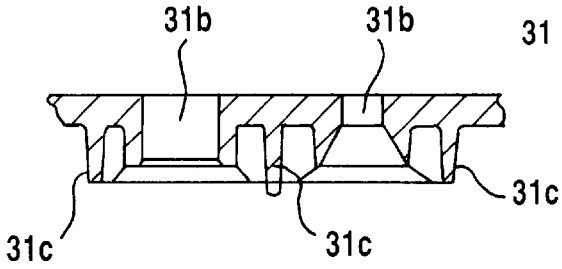
FIG. 9 is a partially enlarged cross-sectional view of the operation unit.

As shown in FIG. 1, the inner main casing 31 has a display window 31*a* for exposing the LCD 34 at the front wall and a plurality of openings 31*b* for fitting the operation buttons S. The sheet member 35 is attached to the inner main casing 31 in a state that a portion of the sheet member 35 other than the operation buttons S is pressed against the inner surface of the inner main casing 31 by the printed circuit board 32. In detail, as shown in FIGS. 4 and 9, a plurality of supporting ribs 31*c* are formed on the inner surface of the inner main casing 31, and a whole peripheral edge and longitudinal central portion of the sheet member 35 are sandwiched between the supporting ribs 31*c* and the circuit board 32. Each supporting rib 31*c* surrounds the periphery of the opening 31*b* to prevent the peripheral portion of the opening 31*b* from being deformed when the operation button S is depressed.

As will be mentioned later, in this embodiment, the time switch can control two circuit loads individually. In detail, the time switch can select any one of operation modes among the first to third operation modes (1) to (3), i.e., the first operation mode (2) in which loads can be individually turned ON and OFF by the timer circuit, the second operation mode (2) in which all loads are kept in an ON-state regardless of the operation of the timer circuit, and the third operation mode (3) in which all loads are kept in an OFF-state regardless of the operation of the timer circuit. The selection of the operation mode is performed by slide switches SW1 and SW2 equipped on the printed circuit board 32 and provided for each timer circuit as shown in FIG. 1. The printed circuit board 32 has two operation pilot lamps L1 and L2 each made of a light-emitting diode for showing the operation state of each timer circuit, and one power pilot lamp L3 for showing the power ON/OFF state.

The clock function block 21 is provided with a battery B such as a lithium battery as a back-up power source in case of a power failure of the commercial power source. The battery B is provided to a battery board 36 which is a member separated from the printed circuit board 32. The battery board 36 is a member separated or detached from the printed circuit board 32. The battery board 36 is held by holding ribs (not shown) each upwardly protruding from the inner surface of the inner main casing 31. Furthermore, a part of the battery board 36 is cramped by and between the inner surface of the inner main casing 31 and the circuit board 32 so as to be severely fixed to the inner main casing 31. The battery board 36 is electrically connected to the printed circuit board 32 by way of electric wires 37 having a connector (receptacle) 37*a* at its one end. The printed circuit board 32 has a connector (post) 37*b* for detachably connecting the connector (receptacle) 37*a*. Therefore, in a case where the battery B is disposed or replaced, the battery board 36 can be detached from the printed circuit board 32 by disconnecting connectors 37*a* and 37*b*. Thus, the battery B can be disposed easily and safely, which in turn avoids the pollution of the environment due to the contents of the battery B and enhances the re-use of the contents of the battery B.

The inner main casing 31 has a dented portion 31*d* at the right side of the display window 31*a*. Provided at the bottom of the dented portion 31*d* are openings 31*e* for fitting the operation pilot lamps L1 and L2 and the power pilot lamp L3 and openings 31*f* for fitting operation handles 38 of switches SW1 and SW2. A display sheet 39 made of opaque material is disposed in the dented portion 31*d* and adhered thereto by gluing or fusing it. In case where two switches SW1 and SW2 are provided to the time switch as described above, the display sheet 39 should have two openings 39*a* for the operation handles 38 and three openings 39*b* for the two operation pilot lamps L1, L2 and one power pilot lamp L3 so that these pilot lamps can be visually confirmed. In a case where a single switch SW1 or SW2 is provided to the time switch, the display sheet 39 should have only one opening 39*a* for the handle of the switch and two openings 39*b* for the pilot lamps L1 (or L2) and L3. As it is understood from the above, by selecting an appropriate display sheet 39 having a different number of openings 39*a*, 39*b* and applying it to an inner main casing 31 having a maximum number of openings 31*f* and 31*e*, the inner main casing 31 can be commonly used for any type of time switches having a different number of the switches SW1, SW2. The relationship between the display sheet 39 and the inner main casing 31 is not limited to the aforementioned embodiment. For example, the maximum number of openings for the switch handles and the pilot lamps may be provided to the inner main casing 31, and some of the openings which are not in use may be covered by the display sheet 39 so as not to be visually confirmed.

On the front surface of the inner main casing 31 at the left side of the display window 31*a*, a time conversion table 40 showing the relationship between the 24-hour scale and the 12-hour scale is provided. In the time conversion table, the 24-hour scale and the 12-hour scale are provided side by side so that the user can easily convert one into the other. The 12-hour scale is accompanied by the letters, "am" or "pm". For example, if the 24-hour scale is shown as: 0:00; 3:00; 6:00; 9:00; 12:00; 15:00; 18:00; and 21:00, the 12-hour scale will be shown as: 0:00 am; 3:00 am; 6:00 am; 9:00 am; 0:00 pm; 3:00 pm; 6:00 pm; and 9:00 pm. This table enables the user who lives in a country or region where the 12-hour scale is mainly employed to use the time switch employing the 24-hour scale display. In other words, the user can easily convert the time scale displayed on the LCD 34 in the 24-hour scale into the 12-hour scale. Thus, even if the user is not familiar with the 24-hour scale, the user can correctly set the time switch by converting the 24-hour scale displayed on the display 34 into the 12-hour scale.

The time conversion table 40 may be printed by a silk printing method or a tampon printing method. Alternatively, a sheet on which the time conversion table 40 is printed may be adhered to the inner main casing 31. In a case where the time conversion table 40 is provided, the description or appearance of the time scale displayed on the LCD 34 may preferably be the same as in the time conversion table 40 to enable an easy conversion of the time scale by utilizing the time comparison table 40.

Figure 3:
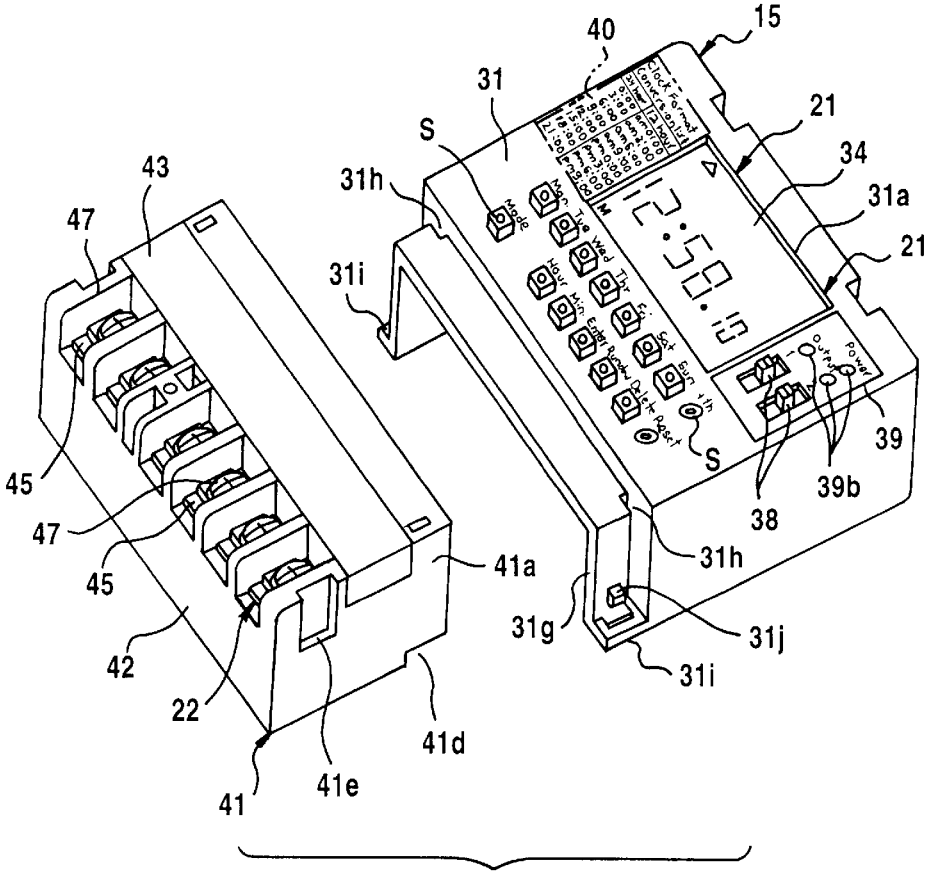
FIG. 3 is a perspective view of the main portion in a state that a terminal holder is detached from the inner main casing.

As already mentioned above, the terminal holder 41 is connected to the inner main casing 31. As shown in FIG. 3, the inner main casing 31 has a channel-shaped connection portion 31*g* protruding from the lower edge thereof. The connection portion 31*g* is provided with a pair of guide grooves 31*h* extending in the fore and aft directions (the up-and-down direction in FIG. 3) at the basal end of the connection portion 31*g*. The connection portion 31*g* is provided with a pair of outwardly protruded flange portions 31*i* formed at the rear ends thereof and a pair of outwardly protruded engaging protrusions 31*j* formed at the side surface of the connection portion 31*g*.

Figure 12:
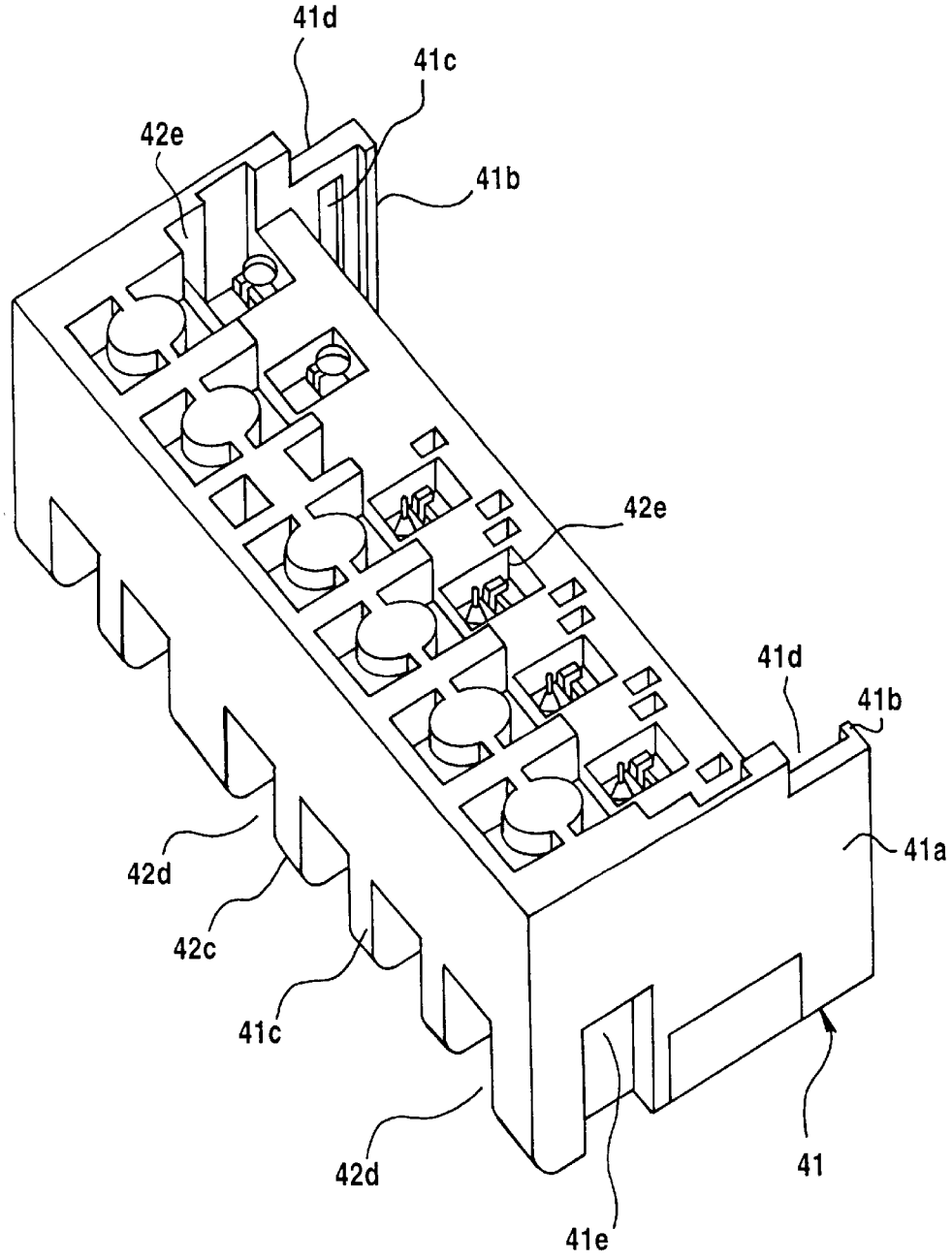
FIG. 12 is a perspective view of the reversed side of the terminal holder.

On the other hand, as shown in FIG. 12, the terminal holder 41 has a generally C-shaped connection body 41*a* with a pair of inwardly protruded guide edges 41*b* formed at the upper edges of the side walls (at the right hand end of the side walls in FIG. 8). Furthermore, the terminal holder 41 has engaging dented portions 41*c* at the inside surfaces of the side walls for engaging the fixing protrusions 31*j* of the inner main casing 31. The connection body 41*a* has cut-out portions 41*d* at the upper rear ends of the connection body 41*a* (at the upper right hand ends of the side walls of the connection body 41*a* in FIG. 12) for fitting the flange portions 31*i*. Therefore, when the terminal holder 41 is slid rearward with the guide edges 41*b* and 41*b* fitted in the guide grooves 31*h*, the engaging protrusions 31*j* are engaged with the engaging dented portions 41*c*, resulting in an integral coupling of the inner main casing 31 and the terminal holder 41.

Figure 10:
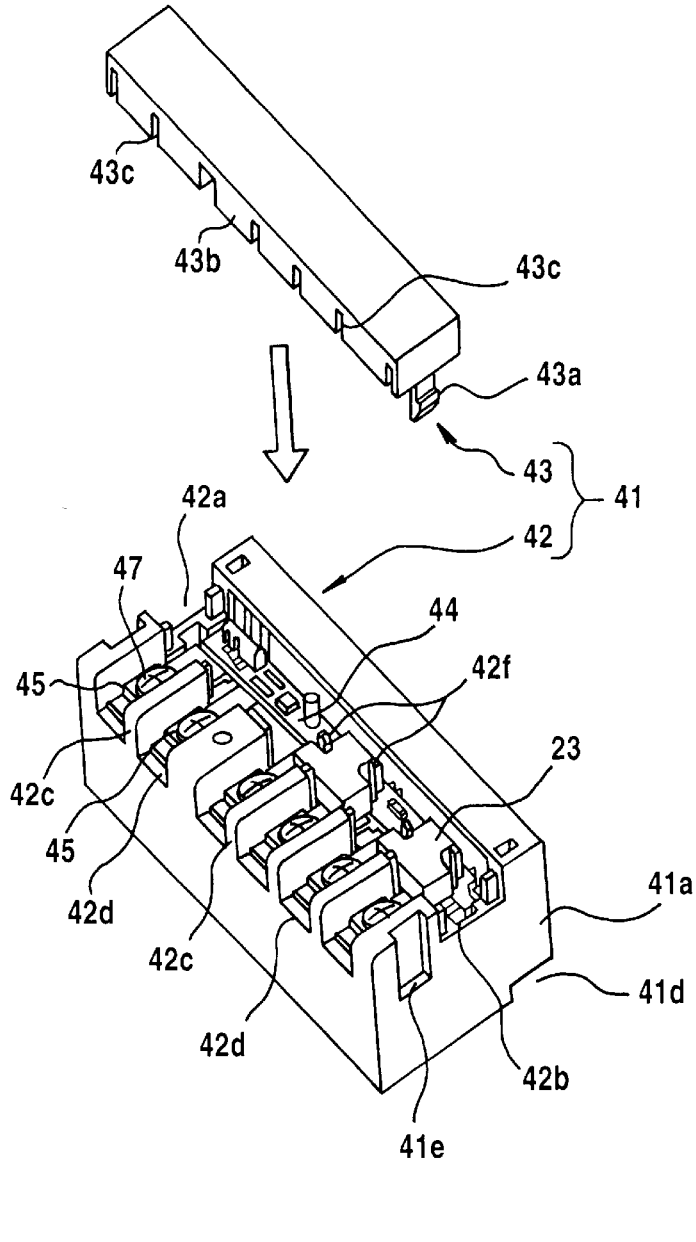
FIG. 10 is a perspective view of a terminal holder in a state that a holder cover is detached from the main terminal holder.
Figure 11:
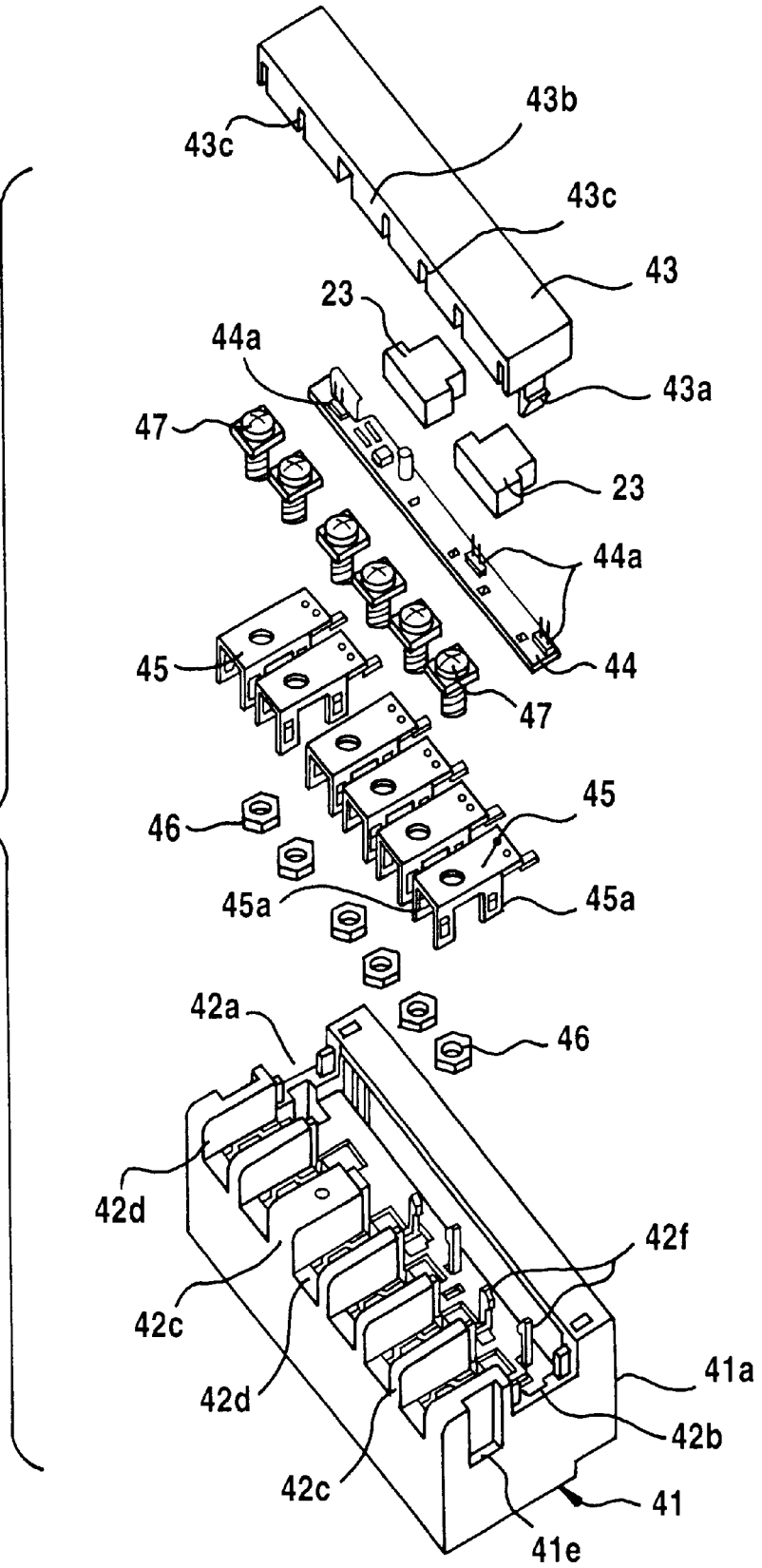
FIG. 11 is an exploded perspective view of the terminal holder.

As shown in FIGS. 10 and 11, the terminal holder 41 includes a main terminal holder 42 and a holder cover 43 disposed on the main terminal holder 42. In detail, the main terminal holder 42 has, at its upper central portion, a central dented portion 42*a* extending in the longitudinal direction thereof. The central dented portion 42*a* is covered by the holder cover 43, and is communicated to an inner space of the connection body 41*a*. The holder cover 43 is provided with a pair of rearwardly protruded engaging ledges 43*a* at the longitudinal opposite edges thereof. Thus, the holder cover 43 is connected to the main terminal holder 42 by engaging the engaging ledges 43*a* with the engaging holes 42*b*. At the front lower end portion of the main terminal holder 42, a plurality of terminal holding dented portions 42*d* separated by a plurality of partitions 42*c* are provided. The holder cover 43 has a partitioning wall 43*b* having a plurality of slits 43*c*, and is connected to the main terminal holder 42 such that the partitioning wall 43*b* is located between the central dented portion 42*a* and the terminal holding dented portions 42*d* so as to partition them with the partitions 42*c* fitted in the slits 43*c*.

Figure 13:
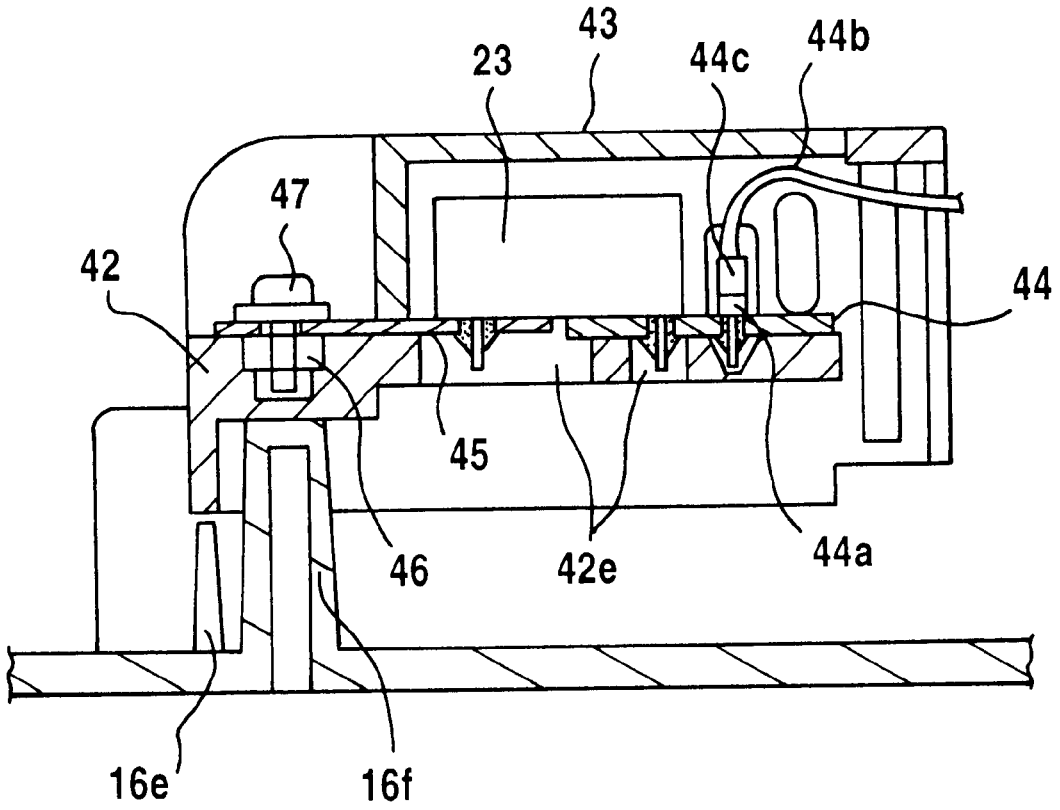
FIG. 13 is a cross-sectional view of the connecting portion of the terminal holder and the outer main casing.

In the central dented portion 42*a*, a circuit board 44 is mounted. The circuit board 44 is equipped with two relays 23 and circuit parts driven by a commercial power for driving the relays 23. As shown in FIG. 11, the circuit board 44 is also equipped with a connector (post) 44*a* for electrically connecting the circuit board 44 to the circuit board 32 mounted to the inner main casing 31. As shown in FIG. 13, the connector 44*a* is detachably connected to a connector (receptor) 44*c* provided at an end of electric wire 44*b* which is connected to the circuit board 32. The circuit board 44 is brazed to terminals 45 to which a commercial power source is supplied. The terminals of the relay 23 are brazed to terminals 45 to which a load is connected. Each terminal 45 is disposed in each terminal holding dented portion 42*d* and fixed to the main terminal holder 42 by engaging a terminal bolt 47 with a nut 46 disposed at the bottom of the dented portions 42*d*. Each terminal 45 has fixing legs 45*a* protruding rearward at the right and left side edges thereof as shown in FIG. 11, and fixed to the main terminal holder 42 with the fixing legs 45*a* inserted into the bottom of the dented portion 42*d*.

Since the central dented portion 42*a* and the terminal holding dented portions 42*d* are partitioned by the partitioning wall 43*b* of the holder cover 43, electric wires are prevented from contacting to the circuit board 44 during connecting operation of the electric wires to the terminals 45. In addition, the circuit board 44 is prevented from being adhered by foreign substances. In the meantime, as shown in FIGS. 12 and 13, the main terminal holder 42 has penetrated openings 42*e* at its appropriate portions for an easier brazing operation for connecting the terminal 45 to the circuit board 44 and/or the relay 23.

As is apparent from the structure shown in FIG. 11, since each component to be mounted to the terminal holder 41 is assembled to the main terminal holder 42 from its front side, each component can be attached to the main terminal holder 42 from one direction, which facilitates the assembling operation. In detail, the nuts 46 are attached to the main terminal holder 42. Next, each of the terminals 45 is forcibly fitted into each of the terminal holding dented portion 42*d*, and then the terminal bolt 47 is engaged with the nut 46. Thereafter, the circuit board 44 is inserted into the central dented portion 42*a*, and then the relays 23 are attached. The relay 23 is held by a pair of holding ledges 42*f* protruded from the bottom of the central dented portion 42*a*, as shown in FIGS. 10 and 11. At this stage, the main terminal holder 42 is turned over, and the brazing is carried out through the penetrated opening 42*e*. At this time, functions of the parts mounted to the terminal holder 41 are examined. After the examination, the fabrication of the terminal holder 41 is accomplished by attaching the holder cover 43 on the main terminal holder 42.

Figure 14:
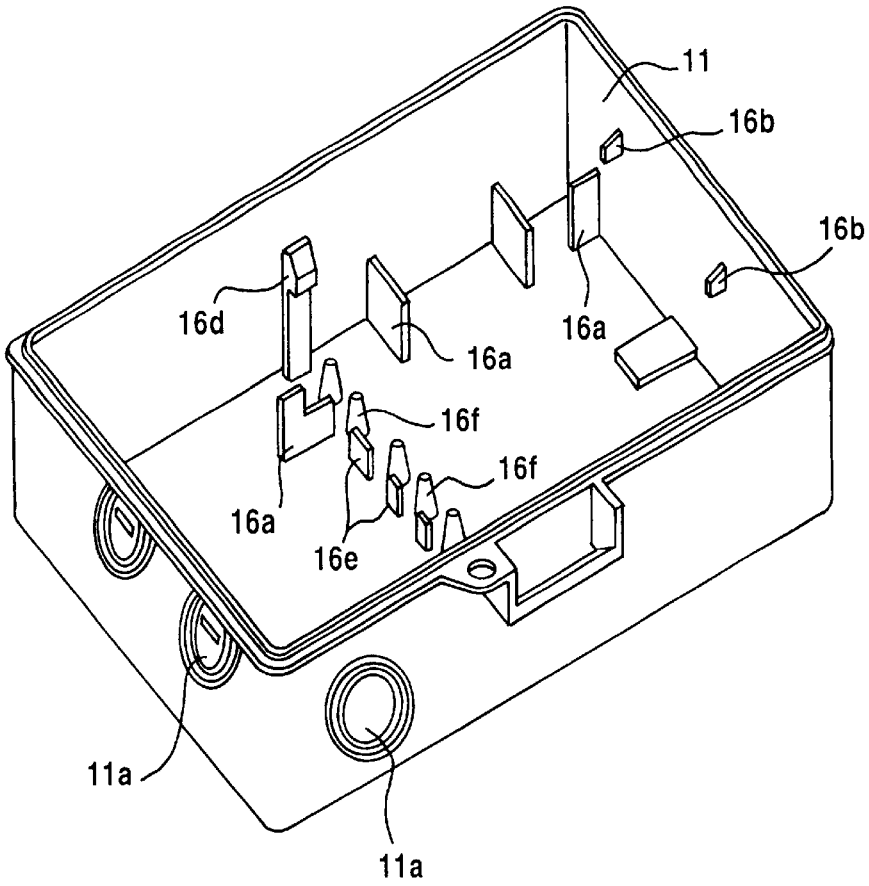
FIG. 14 is a perspective view of the outer main casing.

As mentioned above, the inner casing 15 is formed by integrally connecting the inner main casing 31 and the terminal holder 41, and is accommodated in the outer main casing 11. As shown in FIG. 14, the outer main casing 11 has, at its inner surface of the rear wall, a plurality of supporting ribs 16*a* on which the inner casing 15 is placed. On the inside surface of the upper wall (right side wall in FIG. 14) of the outer main casing 11, a pair of engaging protrusions 16*b* are formed. Thus, the inner main casing 31 is fixed in the outer main casing 11 by engaging the engaging protrusions 16*b* with the corresponding engaging protrusions (not shown) formed in the sliding grooves 16*c*. On the inside surfaces of the right and left side walls of the outer main casing 11, a pair of hooks 16*d* are formed, whereby the engaging portions of the hooks 16*d* are engaged with the dented portions 41*e* each formed on the side upper portion of the terminal holder 41. Thus, the terminal holder 41 is fixed to the outer main casing 11. In other words, the inner casing 15 is fixed to the outer main casing 11 by the engaging protrusions 16*b* and the hooks 16*d*. Since the inner casing 15 is supported by the front ends (upper ends in FIG. 14) of the supporting ribs 16*b*, a space is formed between the inner surface of the rear wall (bottom wall in FIG. 14) of the outer main casing 11 and the rear surface of the inner casing 15. Therefore, a plurality of ribs 16*e* are formed on the inner surface of the rear wall (bottom wall in FIG. 14) of the outer main casing 11 so as to seal the gap formed between the inner surface of the rear wall (bottom wall in FIG. 14) of the outer main casing 11 and the lower rear edge of the terminal holder 41. These ribs 16*e* prevent an invasion of foreign substances into the inner casing 15 through the aforementioned gap although the inner casing 15 has an opened portion at its rear side. The outer main casing 11 has bosses 16*f* at its inner surface of the rear wall so as to be located at portions corresponding to the terminal bolts 47. Thus, these bosses 16*f* contact to the rear surface of the terminal holder 41 to support the force imparted to the terminal holder 41 when the terminal bolt 47 is being tightened.

As shown in FIGS. 2 and 14, the outer main casing 11 has knockout portions 11*a* each having an easy-broken-thin peripheral portion at the lower side walls, the lower end wall and the lower end portion of the rear wall. By removing the knockout portions 11*a*, openings for introducing external wires into the outer main casing 11 can be formed.

In this embodiment, although the inner casing 15 is connected to the outer main casing 11 by the engaging protrusions 16*b* and the hooks 16*d*, the inner casing 15 may be connected to the outer main casing 11 by screws, or by bolts and nuts. Furthermore, the inner main casing 31 may be connected to the terminal holder 41 by screws or the like. In the first embodiment, although the printed circuit board 32 is electrically connected to the circuit board 44 via the connectors 44*a* and 44*c*, they may be directly connected each other, i.e., without using the connectors 44*a* and 44*c*. Similarly, the battery board 36 may be connected to the printed circuit board 32 without using the connectors 37*a* and 37*b*.

Figure 15:
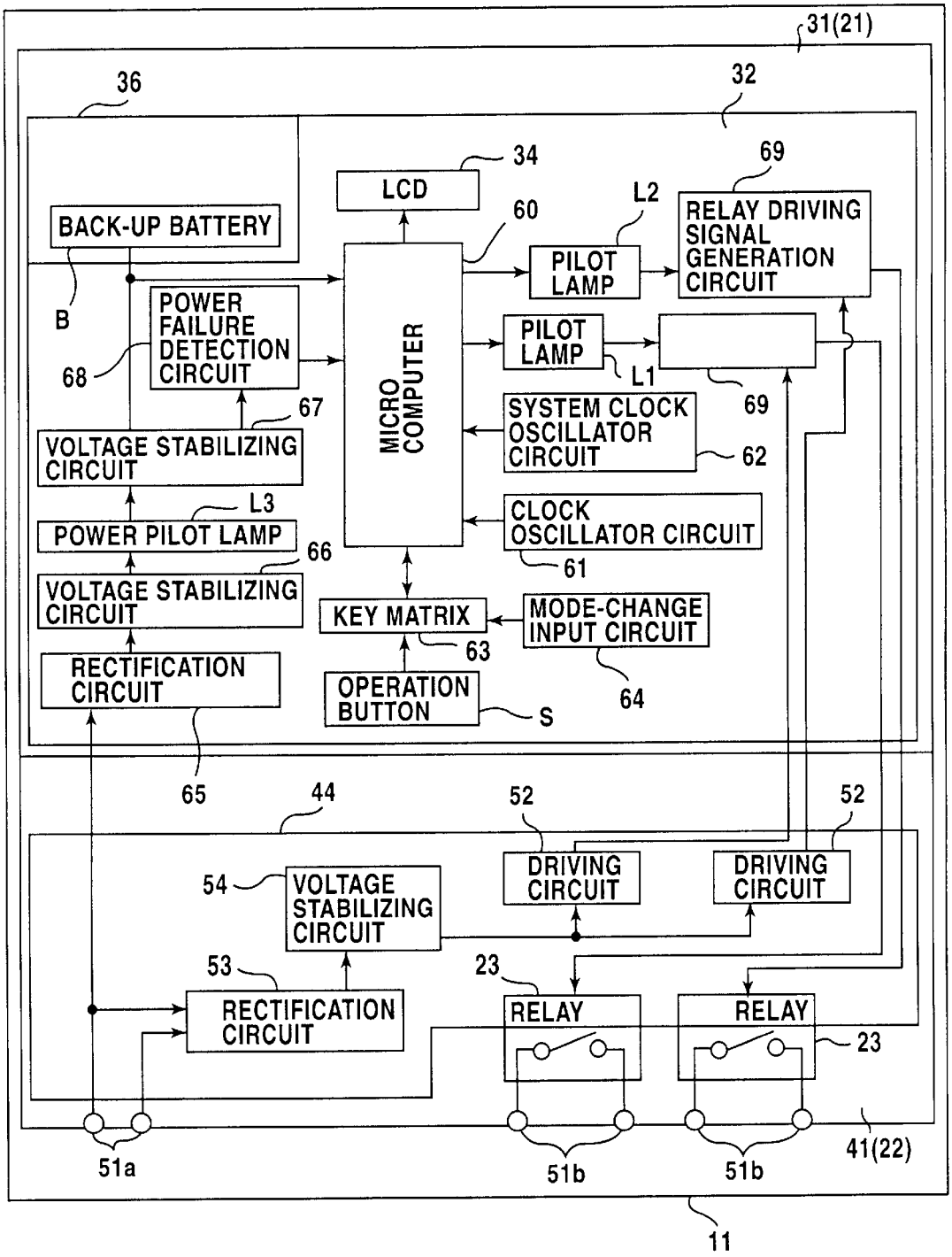
FIG. 15 illustrates a block diagram of the time switch circuit.

FIG. 15 illustrates a circuit structure of this embodiment. FIG. 15 also illustrates the relationship between the inner main casing 31 and the terminal holder 41 and the arrangement of the circuits on the circuit boards 32 and 44 which are mounted in the inner main casing 31 and the terminal holder 41, respectively.

The terminals 45 used as power terminals 51*a* are connected to the circuit board 44, and the terminals 45 used as load terminals 51*b* are connected to the relays 23. In this embodiment, two relays 23 are provided. Each relay 23 is controlled by a driving circuit 52 equipped to the circuit board 44. Electric power supplied from the commercial power source via the power terminals 51*a* is supplied to the driving circuits 52 by way of the rectification circuit 53 and the voltage stabilizing circuit 54. The rectification circuit 53 and the voltage stabilizing circuit 54 are equipped to the circuit board 44.

The clock function block 21 includes a microcomputer 60 realizing a clock function for clocking the current time and a timer function for setting the time schedule. The microcomputer 60 clocks the current time based on the clock signals supplied from the clock oscillator circuit 61, and is operated based on the clock signals supplied from the system clock oscillator circuit 62. The rubber switches having the operation buttons S are arranged in a matrix arrangement to form the key matrix 63. The key matrix 63 recognizes which of the operation buttons S is depressed to obtain operation information, and then supplies the operation information to the microcomputer 60.

The microcomputer 60 is controlled by the mode-change input circuit 64 so as to select one of its operation modes. The operation modes include an operation mode for independently controlling two load circuits as in this embodiment, an operation mode for collectively controlling two load circuits, an operation mode for controlling loads based on a weekly time schedule, and an operation mode for controlling loads based on a daily time schedule. In other words, different kinds of programs are installed in the microcomputer 60. One of them is selected by the mode-change input circuit 64, and is executed by the microcomputer 60. Also connected to the microcomputer 60 are the LCD 34, the operation pilot lamps L1, L2, and the power pilot lamps L3. Further connected to the microcomputer 60 is the back-up battery B for supplying a power to keep both the clock function and the set time-schedule in case of a power failure or the like.

The printed circuit board 32 is provided with a rectification circuit 65 connected to the power terminals 51*a*. The pulsating voltage outputted form the rectification circuit 65 is stabilized by the voltage stabilizing circuit 66. The output of the voltage stabilizing circuit 66 turns on the power pilot lamp L3. The output of the voltage is supplied to the microcomputer 60 via another voltage stabilizing circuit 67 as a power source of the microcomputer 60. The output of the voltage stabilizing circuit 67 is supplied to the power failure detection circuit 68. The power failure detection circuit 68 detects the power failure of the commercial power source based on the drop of the output voltage of the voltage stabilizing circuit 67. When the power failure is detected by the power failure detection circuit 68, the microcomputer 60 stops all functions other than the essential functions, such as a clock function that are required to be kept working during a power failure. When the commercial power source is restored, the microcomputer 60 detects the restoration and resumes all of the functions. Since the back-up battery B supplies the electric power to the limited functions required to be kept alive during the power failure, only very small amount of electric power is consumed during the power failure. As a result, if a lithium battery or the like is used as the back-up battery B, it is not required to replace it with a new one for ten or more years.

When the time schedule set in the microcomputer 60 is executed by operating the operation buttons S, the microcomputer 60 supplies an instruction to the relay driving signal generation circuit 69 when the current time comes to coincide with the set time of the time schedule. Then, a driving signal is outputted from the relay driving signal generation circuit 69 driven by the driving circuit 52 to control the relay 23. In this embodiment, since two relay driving signal generation circuits 69 are provided for individually controlling the relays 23, two load circuits can be controlled separately. Thus, each output state of the relays 23 can be selected by the two switches SW1 and SW2.

(Second Embodiment)

Figure 16:
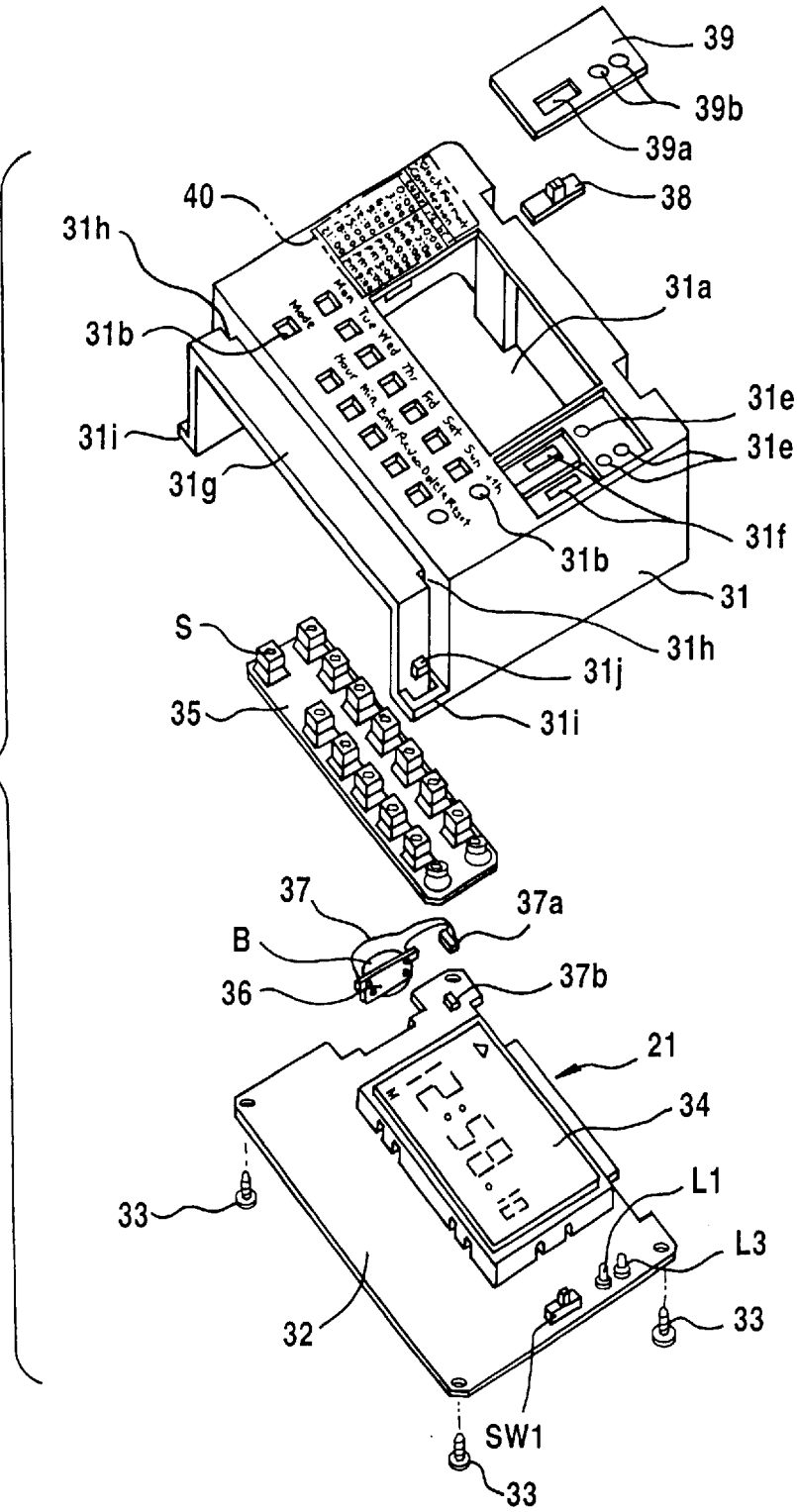
FIG. 16 is an exploded perspective view of a main portion of a time switch according to a second embodiment of the present invention.
Figure 17:
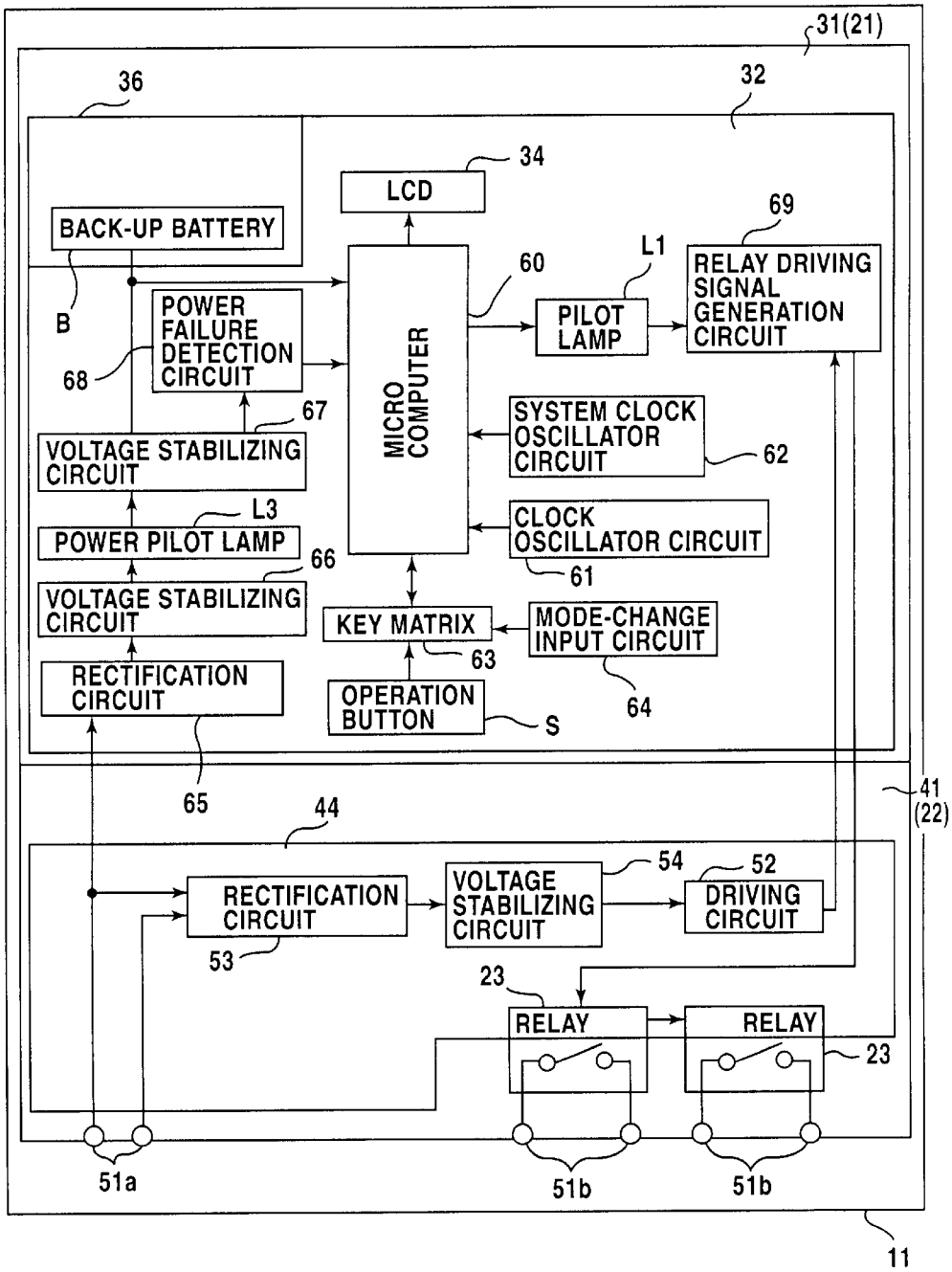
FIG. 17 illustrates a block diagram of the time switch circuit of the second embodiment.
Figure 18:
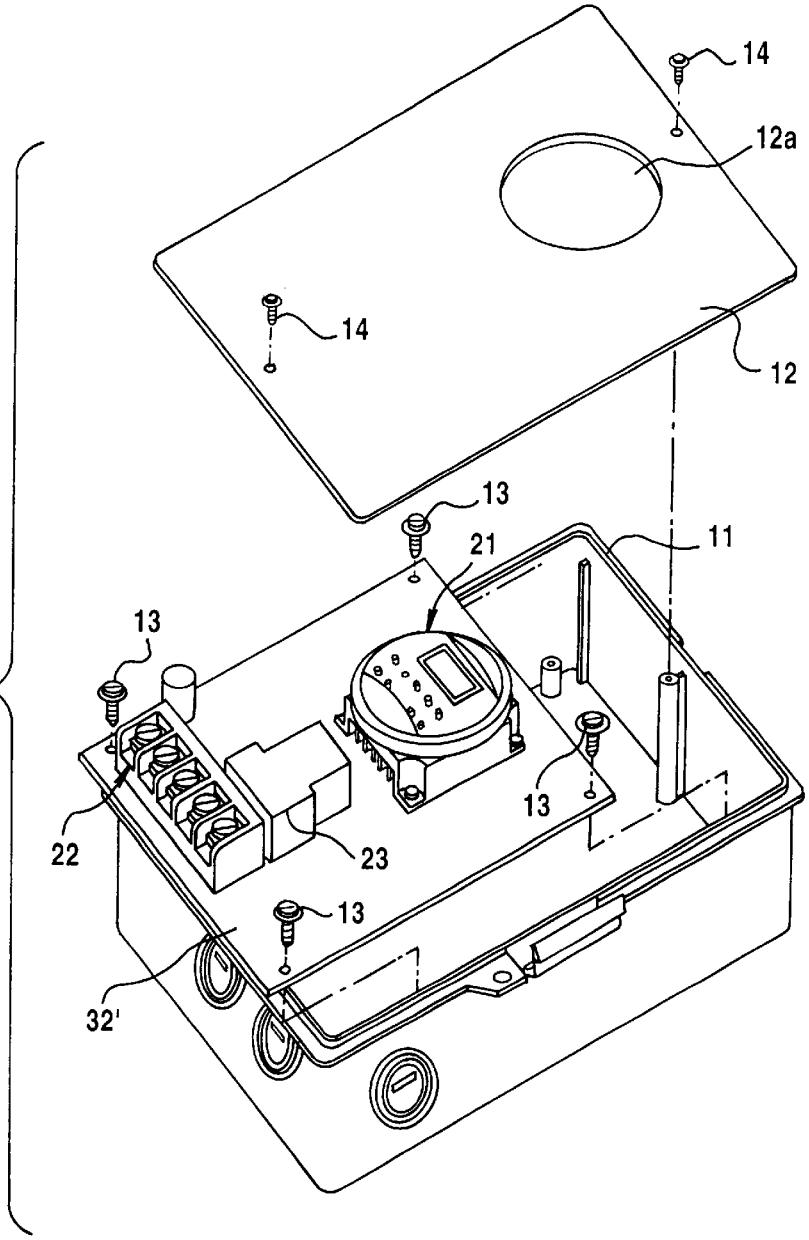
FIG.18 RELATED ART
FIG. 18 is an exploded perspective view of a time switch according to a related timeswitch.

The time switch according to the second embodiment can control two circuit loads as understood from FIG. 17. However, these two loads are not separately controlled as in the first embodiment, but are controlled in the same manner. In summary, two relays 23 are connected in series or in parallel, and single relay driving signal generation circuit 69 and single driving circuit 52 are provided. This circuit structure only requires one operation pilot lamp L1 and one switch SW1. If an inner main casing 31 for accommodating the circuit as shown in the first embodiment which individually controls two loads and an inner main casing 31 for accommodating the circuit as shown in the second embodiment which controls two loads in the same manner are manufactured separately, the manufacturing costs will increase and a large space for accommodating such inner main casings 31 will be required because of the different types of inner main casings 31. Accordingly, in this embodiment, the same inner main casing 31 is commonly used for both the aforementioned circuits, and different display sheets 39 are selectively used for the inner main casing 31. In detail, in this embodiment, as shown in FIG. 16, the display sheet 39 is provided with a single opening 39*a* for the handle of the single switch SW1 and two openings 39*b* for one operating pilot lamp L1 and one power pilot lamp L3. Thus, the display sheet 39 covers the unused openings 31*f* and 31*e* formed in the dented portion 31*d* of the inner main casing 31 so as not to expose these openings. The other structures and operations are the same as in the first embodiment.

According to the first aspect of the present invention, a time switch includes a circuit board equipped with a time switch circuit and a display for displaying a time-schedule set by a user and a current time, an operation unit having a plurality of push buttons for setting the time-schedule and the current time, and a casing in which the circuit board and the operation unit are accommodated, the casing having a plurality of openings for fitting the plurality of push buttons, wherein the operation unit includes a resilient sheet member integrally equipped with the plurality of push buttons and a plurality of conductive contact members each disposed on a portion corresponding to each of the plurality of push buttons, wherein the circuit board has a plurality of pairs of contact portions, each pair of contact portions being to be electrically connected via the conductive contact member while the push button is being depressed, and wherein the operation unit is supported by and between the casing and the circuit board in a state that a peripheral portion of the sheet member is clamped by and between an inner surface of the casing and the circuit board with the plurality of buttons fitted in the plurality of openings.

With this time switch, since the operation unit is supported by the casing and the circuit board, the time switch can be simple in structure, resulting in an easy assembly and a reduced manufacturing cost.

In the aforementioned time switch, the time switch circuit may have a clock function for clocking the current time and a time-schedule setting function for setting the time-schedule, and includes a load controlling circuit for controlling a load connected to the time switch when the current time comes to coincide with the set time-schedule.

It is preferable that the casing includes a main casing in which the circuit board and the operation unit are mounted and a terminal holder having a terminal block for connecting a commercial power source and a load, and wherein the main casing is detachably connected to the terminal holder. According to this structure, a connecting operation of a load to the terminal holder can be safely performed because the circuit board is not exposed during the connecting operation of the board. Since the terminal holder can be detached from the main casing, only the circuit board accommodated in the main casing can be subjected to the test operation. Thus, it is not required to evaluate the terminal block, resulting in a reduced check points. Furthermore, the terminal holder can be commonly used for different types of time switch circuits.

According to another aspect of the present invention, a time switch including a circuit board equipped with a time switch circuit and a display for displaying a time-schedule set by a user and a current time, an operation unit having a plurality of buttons for setting the time-schedule and the current time, a casing in which the circuit board and the operation unit are accommodated, the casing having a plurality of openings for fitting switches and pilot lamps provided on the circuit board, and a display sheet attached on a surface of the casing, the display sheet having a plurality of openings for exposing the switches and pilot lamps, wherein the number of the openings formed in the casing corresponds to the maximum number of the switches and pilots lamps to be provided on the circuit board, and wherein the number of the opening formed in the display sheet corresponds to the number of the switches and pilots lamps actually provided on the circuit board, whereby some of the opening formed in the casing not in use are covered by the display sheet.

With this time switch, even in a case where the operation of the circuit board and/or the number of parts provided on the circuit board are changed, it is only required to change a display sheet to be attached on the casing. In other words, it is not required to change the casing. As a result, the storage space can be decreased, and various types of time switches can easily be provided.

The time switch circuit may have a clock function for clocking the current time and a time-schedule setting function for setting the time-schedule, and includes a load controlling circuit for controlling a load connected to the time switch when the current time comes to coincide with the set time-schedule.

It is preferable that the casing includes a main casing in which the circuit board and the operation unit are mounted and a terminal holder having a terminal block for connecting a commercial power source and a load, and wherein the main casing is detachably connected to the terminal holder. According to this structure, a connecting operation of a load to the terminal holder can be safely performed because the circuit board is not exposed during the connecting operation. Since the terminal holder can be detached from the main casing, only the circuit board accommodated in the main casing can be subjected to the test operation. Thus, it is not required to evaluate the terminal block, resulting in a reduced check points. Furthermore, the terminal holder can be used for any types of time switch circuits.

It is preferable that the time switch further includes a time conversion table for converting a 12-hour time scale into a 24-hour scale, and vice versa. With this time switch, an easy conversion of the time scale can be performed even if the displayed time scale is not familiar to the user.

It is preferable that the time conversion table is provided on an outer surface of the casing.

It is also preferable that the time conversion table is located next to the display, and that the display displays the same type of character as that used in the time conversion table.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

This application claims priority of Japanese Patent Application No. Hei 10-365656 filed on Dec. 22, 1998, the disclosure of which is incorporated by reference in its entirety.

What is claimed is:

1. A time switch, comprising:

a circuit board equipped with a time switch circuit and a display for displaying a time-schedule set by a user and a current time;

an operation unit having a plurality of push buttons for setting the time-schedule and the current time; and a casing in which said circuit board and said operation unit are accommodated, said casing having a plurality of openings for fitting said plurality of push buttons and a plurality of supporting ribs each surrounding each of said openings;

wherein said operation unit includes a resilient sheet member integrally equipped with said plurality of push buttons and a plurality of conductive contact members each disposed on a portion corresponding to each of said plurality of push buttons, wherein said circuit board has a plurality of pairs of contact portions, each pair of contact portions being to be electrically connected via said conductive contact member while said push button is being depressed, and wherein said operation unit is supported by and between said casing and said circuit board in a state that said sheet member is clamped by and between said plurality of supporting ribs of said casing and said circuit board with said plurality of buttons fitted in and outwardly protruded from said plurality of openings.

2. The time switch as recited in claim 1, wherein said time switch circuit has a clock function for clocking the current time and a time-schedule setting function for setting the time-schedule, and includes a load controlling circuit for controlling a load connected to said time switch when the current time comes to coincide with the set time-schedule.

3. The time switch as recited in claim 1 or 2, wherein said casing includes a main casing in which said circuit board and said operation unit are mounted and a terminal holder having a terminal block for connecting a commercial power source and a load, and wherein said main casing is detachably connected to said terminal holder.

4. The time switch as recited in claim 1, further comprising a time conversion table for converting a 12-hour time scale into a 24-hour scale, and vice versa.

5. The time switch as recited in claim 4, wherein said time conversion table is provided on an outer surface of said casing.

6. The time switch as recited in claim 5, wherein said time conversion table is located next to said display.

7. The time switch as recited in claim 4, wherein said display displays the same type of character as that used in said time conversion table.

* * * * *